US005125606A

United States Patent [19]

Cassano et al.

[11] Patent Number: 5,125,606

[45] Date of Patent: Jun. 30, 1992

[54] WRIST SUPPORT FOR COMPUTER KEYBOARD

[75] Inventors: Florence Cassano, Roslyn Heights; Albert R. Nash, East Williston, both of N.Y.

[73] Assignee: Wrist-Eze Products, Inc., Roslyn Heights, N.Y.

[21] Appl. No.: 714,205

[22] Filed: Jun. 12, 1991

[51] Int. Cl.[5] ..... B68G 5/00

[52] U.S. Cl. ..... 248/118; 248/918; 400/715

[58] Field of Search ..... 248/118, 118.1, 118.3, 248/917, 918; 400/715; 361/222; 340/365 C, 365 R

[56] References Cited

U.S. PATENT DOCUMENTS

| | | | |
|---|---|---|---|
| 3,387,881 | 6/1968 | Stepanek | 248/118 |
| 4,089,497 | 5/1978 | Miller | 248/345.1 |
| 4,481,556 | 11/1984 | Berke | 361/222 |
| 4,570,803 | 2/1986 | Peterson | 248/118 X |
| 4,597,606 | 7/1986 | Magee | 248/118 X |
| 4,621,781 | 11/1986 | Springer | 400/715 X |
| 4,688,862 | 8/1987 | Fowler | 312/208 X |
| 4,709,972 | 12/1987 | Labudde | 312/208 |
| 4,973,176 | 11/1990 | Dietrich | 248/118 X |
| 4,976,407 | 12/1990 | Schwartz | 400/715 X |

*Primary Examiner*—J. Franklin Foss
*Attorney, Agent, or Firm*—Galgano & Pelkin

[57] ABSTRACT

A wrist support for use with a computer keyboard including a longitudinally extending rigid board with a foam layer and a cover to compress the foam to form a cushion. A rubber base is placed on the underside of the board. The cushion is placed near a lower edge of a keyboard for support of the wrists. A flat base can be attached to the underside to form a platform on which to rest the keyboard.

4 Claims, 2 Drawing Sheets

WRIST SUPPORT FOR COMPUTER KEYBOARD

BACKGROUND OF THE INVENTION

1. Field of the Invention

This invention relates to a wrist support to be utilized while operating a computer keyboard.

Individuals who spend long hours at computer terminals can develop repetitive stress injuries, one of which is carpal tunnel syndrome. Repetitive tasks may cause swelling in the wrist area, which can compress the nerves that carry feelings to fingers.

2. The Prior Art

The prior art discloses computer terminal supports and hand rests. The U.S. Pat. Nos. to Berke, 4,482,064 and 4,481,556, show computer terminal supports which have a flat section which is placed underneath the terminal. These devices, however, have a gap between the terminal and the support area. The U.S. Pat. No. to Berke, 4,482,063, also shows a computer terminal support with a flat section placed underneath the keyboard. However, this support has a section which extends below the surface of the table, preventing free movement of the keyboard and hand rest. U.S. Pat. Nos. D288,097 and 4,913,390 show other types of keyboard supports.

SUMMARY OF THE INVENTION

It is therefore an object of the present invention to eliminate the aforementioned drawbacks of the prior art and to provide a wrist support which can be placed any distance from the keyboard.

It is a further object of the present invention to provide such a device which can be freely moved along with the keyboard.

These and other related objects are attained according to the invention by a wrist support having a flat, non-skid base and a cushioned support area. The support is generally the same length as the keyboard.

In a second embodiment of the support, the cushioned portion is mounted to a flat surface on which the keyboard can be placed. The cushioned board and keyboard can be freely moved to accommodate the user. In addition, the board can be used as a support for the keyboard, for example, on the user's lap.

BRIEF DESCRIPTION OF THE DRAWINGS

Other objects and features of the present invention will become apparent from the following detailed description considered in connection with the accompanying drawings which discloses two embodiments of the present invention. It should be understood, however, that the drawing is designed for the purpose of illustration only and not as a definition of the limits of the invention.

In the drawing, wherein similar reference characters denote similar elements throughout the several views.

DETAILED DESCRIPTION OF PREFERRED EMBODIMENTS

Figure 1:
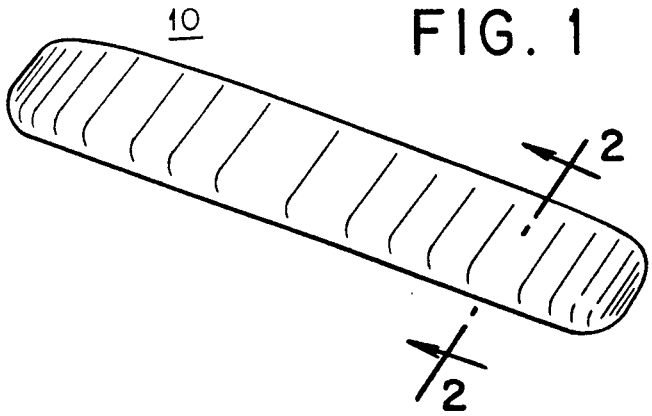
FIG. 1 is a perspective view of a wrist support embodying the present invention.
Figure 2:
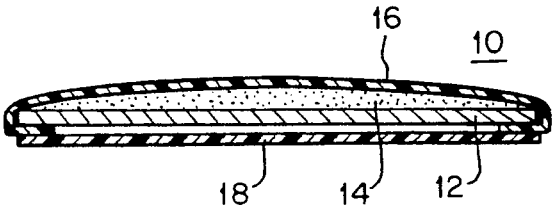
FIG. 2 is a cross-sectional view taken along the line 2—2 from FIG. 1.
Figure 3:
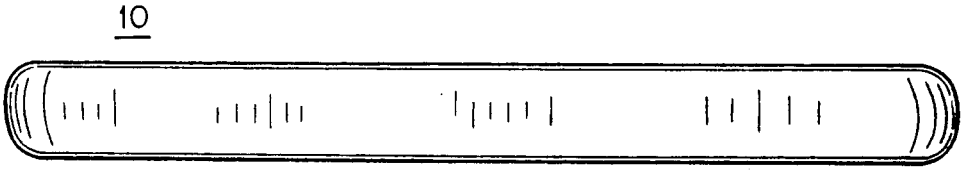
FIG. 3 is a top view.
Figure 4:
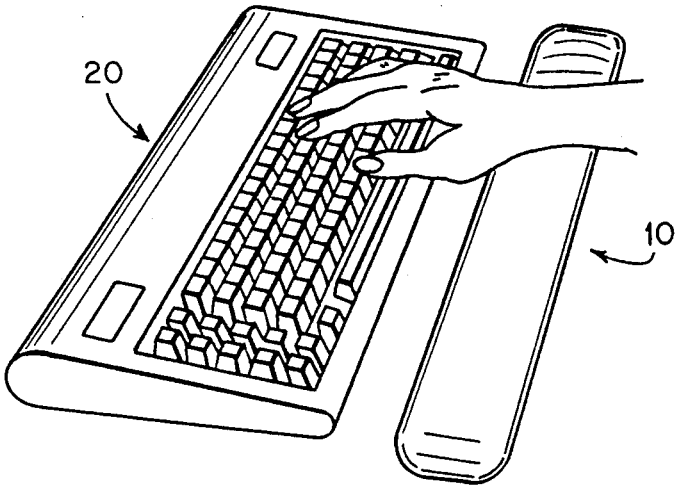
FIG. 4 is a perspective view of the wrist support shown with a computer keyboard.

Turning now in detail to the drawings, and in particular FIGS. 1 and 3, there is shown a wrist support 10 embodying the present invention to be used with a computer keyboard. As can be seen in FIG. 2, a wrist support is made from a preferably wooden slat 12 over which a layer of foam padding 14 is placed followed by a cover 16 which is stapled and glued to the bottom of wooden slat 12. Finally, a non-skid backing 18 made preferably of synthetic rubber is placed along the underside of the wrist support. FIG. 4 shows wrist support 10 placed in close proximity to a computer keyboard 20 for supporting the wrists of the keyboard operator. The wrist support can conveniently be placed at any distance from the bottom of keyboard 20.

Figure 5:
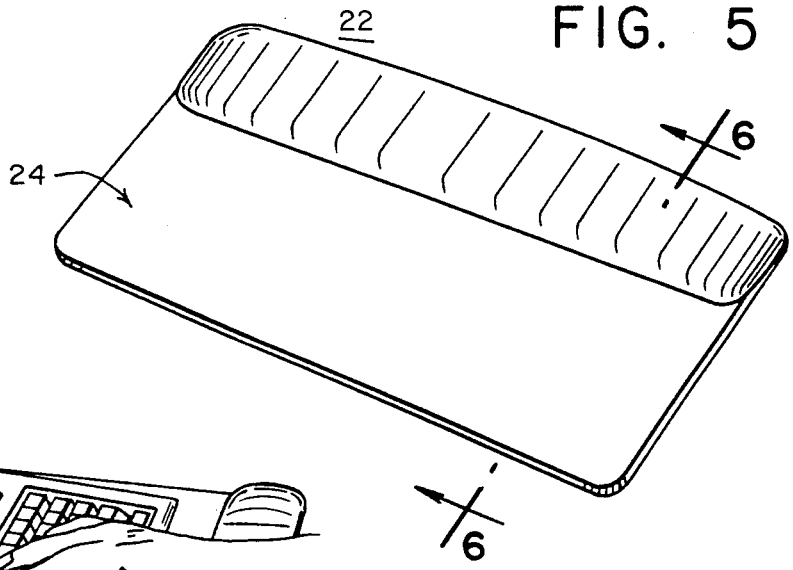
FIG. 5 is a perspective view of an alternate embodiment of the wrist support.
Figure 6:
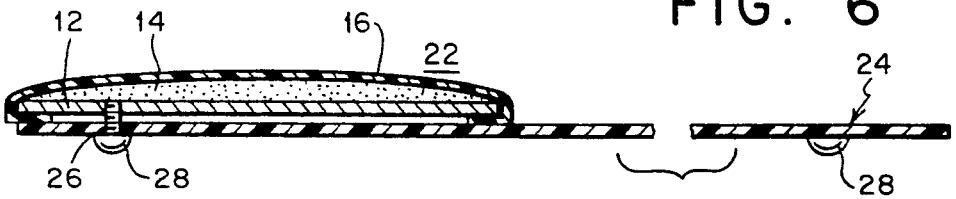
FIG. 6 is a cross-sectional view taken along the line 6—6 from FIG. 5.
Figure 7:
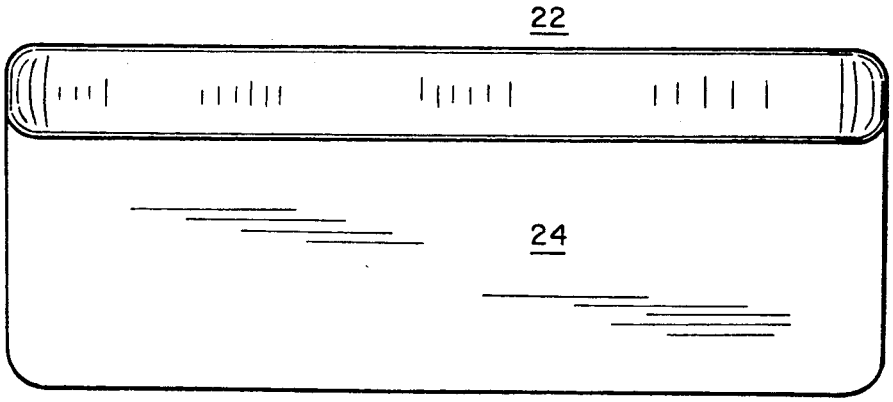
FIG. 7 is a top view.

FIGS. 5 and 7 show an alternate embodiment with a wrist support 22 attached to a platform 24. FIG. 6 shows that the cross-section of the two embodiments are substantially similar, i.e., both include a wooden slat 12, foam padding 14 and cover 16. In the second embodiment, however, a platform 24 is placed underneath the wrist support instead of non-skid backing 18. Several screws 26 are inserted upwards through the platform to attach it to the wooden slat of wrist support 22. Also, in order to make the wrist support with platform easily removable, a set of feet 28 is provided underneath platform 24 to raise platform 24 slightly above the surface on which is it lying.

Figure 8:
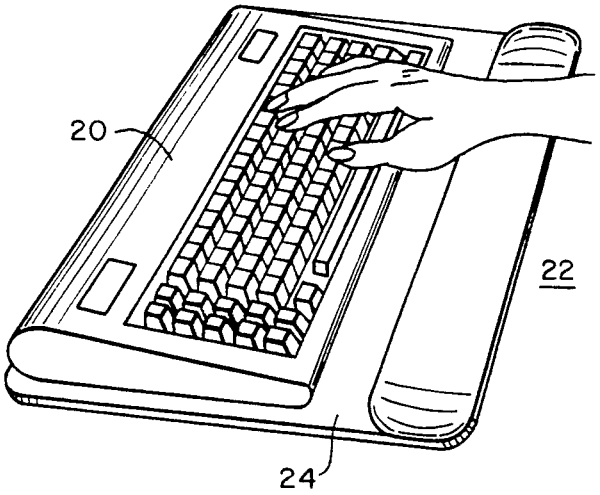
FIG. 8 is a perspective view of the wrist support shown with a computer keyboard.

FIG. 8 shows wrist support 22 with computer keyboard 20. It is possible for keyboard 20 to be moved any distance from a cushioned part of wrist support 22. Also, if the computer work space is limited, wrist support 22 can be moved over the edge of the work space. The wrist support 22 will remain in place due to the weight of keyboard 20 and the cushioned portion of wrist support 22 can still provide support for the keyboard operator's wrists. In addition, the platform can be moved to an uneven surface, for example, the keyboard operator's lap, and can provide support for the keyboard and the computer operator's wrists simultaneously.

In this manner the keyboard operator can easily move the wrist support to a comfortable position. The height of the cushion is very important in order to support the wrists properly. The cushion is ergonomically positioned at approximately the same height as the lower edge of the keyboard. The cover can be made of a variety of materials, for example, Naugahyde TM, which is a brand of strong vinyl-coated fabric made to look like leather.

While only two embodiments of the present invention have been shown and described, it is to be understood that many changes and modifications may be made thereunto without departing from the spirit and scope of the invention as defined in the appended claims.

What is claimed is:

1. A wrist support for use with a computer keyboard comprising:

a longitudinally extending rigid board with a topside and an underside;

a layer of compressible foam material placed on the topside of said board;

a cover having ends placed over said layer of compressible foam material with said ends fixably attached to the underside of said board compressing said layer of compressible foam material between said cover and said board so as to form a cushion; and a non-skid synthetic rubber base placed on the underside of said board over said ends of said cover, said base not extending beyond the periphery of said cushion, the wrist support being generally rectangular in shape and having the same width and height as the lower edge of a computer keyboard for placement on a work surface adjacent to the computer keyboard.

2. In combination, a computer keyboard and a wrist support comprising:

a longitudinally extending rigid board with a topside and an underside generally the same width as the computer keyboard;

a layer of compressible foam material placed on the topside of said board;

a cover having ends placed over said layer of compressible foam material with said ends fixably attached to the underside of said board, compressing said layer of compressible foam material between said cover and said board so as to form a cushion; and a non-skid synthetic rubber base placed on the underside of said board over said ends of said cover, said wrist support generally rectangular in shape and having the same height as the lower edge of a computer keyboard and placed in close proximity to the lower edge of the computer keyboard for cushioned support of the wrist, said base not extending beyond the periphery of said cushion, the wrist support being generally rectangular in shape and having the same width and height as the lower edge of the computer keyboard for placement on a work surface adjacent to the computer keyboard.

3. A wrist support for use with a computer keyboard comprising:

a longitudinally extending rigid board with a topside and an underside;

a layer of compressible foam material placed on the topside of said board;

a cover placed over said layer of compressible foam material fixably attached to the underside of said board compressing said layer of compressible foam material between said cover and said board so as to form a cushion; and a flat plastic and planar base having two opposite sides with an upper and a lower region on one side thereof, said upper region configured and dimensioned to allow placement of the keyboard thereon, said lower region configured and dimensioned to allow placement of said cushion thereon in operative juxtaposition to the keyboard for cushioned support of the wrists, the opposite side lying in a single plane and adapted to be easily movable from a table top work surface to the lap of the computer operator, said flat base forming a tray to support the computer keyboard, said cushion being generally the same width and height as the lower edge of the computer keyboard, and said flat board being generally the same width as the computer keyboard.

4. In combination, a computer keyboard and a wrist support comprising:

a longitudinally extending rigid board with a topside and an underside generally the same width as the computer keyboard;

a layer of compressible foam material placed on the topside of said board;

a cover having ends placed over said layer of compressible foam material with said ends fixably attached to the underside of said board, compressing said layer of compressible foam material between said cover and said board so as to form a cushion; and a flat plastic and planar base having two opposite sides with an upper and a lower region on one side thereof, said upper region configured and dimensioned to allow placement of the keyboard thereon, said lower region configured and dimensioned to allow placement of said cushion thereon in operative juxtaposition to the keyboard for cushioned support of the wrists, the opposite side lying in a single plane and adapted to be easily movable from a table top work surface to the lap of the computer operator, said flat base forming a tray to support the computer keyboard, said cushion being generally the same width and height as the lower edge of the computer keyboard, and said flat board being generally the same width as the computer keyboard.

* * * * *